United States Patent [19]

Edgell et al.

[11] 4,122,320

[45] Oct. 24, 1978

[54] HAND-OPERATED DOUBLE-ACTING TRIGGER SWITCH

[75] Inventors: James Ensign Edgell, Senatobia, Miss.; Charles Franklin Sherrill, Danville, Va.

[73] Assignee: Disston, Inc., Danville, Va.

[21] Appl. No.: 795,076

[22] Filed: May 9, 1977

Related U.S. Application Data

[63] Continuation of Ser. No. 714,911, Aug. 16, 1976, abandoned.

[51] Int. Cl.[2] ..... H01H 9/06; H01H 13/08; H01H 21/10

[52] U.S. Cl. ..... 200/157

[58] Field of Search ..... 200/157, 334, 61.85, 200/42 R, 153 V, 159 R, 321, 322; 173/170

[56] References Cited

U.S. PATENT DOCUMENTS

| | | | |
|---|---|---|---|
| 3,194,084 | 7/1965 | Filander | 200/157 |
| 3,358,108 | 12/1967 | Hansen | 200/334 |
| 3,370,475 | 2/1968 | Hunter et al. | 200/157 |
| 3,646,298 | 2/1972 | Weber et al. | 200/153 V |
| 3,766,352 | 10/1973 | Bigley et al. | 200/157 |
| 3,780,246 | 12/1973 | Beckering et al. | 200/157 |
| 3,847,233 | 11/1974 | Glover et al. | 173/170 |
| 3,854,020 | 12/1974 | Glover et al. | 200/321 |

*Primary Examiner*—Anthony V. Ciarlante
*Attorney, Agent, or Firm*—B. B. Olive

[57] ABSTRACT

A hand-operated, double-action trigger switch is mounted in the handle area of a portable electric tool and comprises a thumb-actuated safety button protruding from the upper portion of the handle and a finger depressable trigger on the lower portion of the handle. The safety button must be pushed by the operator's thumb before the trigger can be depressed. Upon release of the pressure on the trigger, the safety button returns to its original position and effectively places the device in an inoperable or locked position.

5 Claims, 8 Drawing Figures

HAND-OPERATED DOUBLE-ACTING TRIGGER SWITCH

This is a continuation, division, of application Ser. No. 714,911, filed Aug. 16, 1976 now abandoned.

BACKGROUND OF THE INVENTION

1. Field of the Invention

This invention relates to safety trigger switches adapted for use on portable electric tools.

2. Description of the Prior Art

The prior art in safety switches for hand held tools has generally provided relatively complicated switches with numerous molded pieces, springs and the like. Most such switches have separate lock and actuator elements that require a manual locking operation. One such switch is described in U.S. Pat. No. 3,780,246. This patent discloses a trigger actuator that is normally biased off and can be manually operated in the "on" position when the operator has his hand on the tool handle. Means is provided to automatically lock the trigger temporarily in the "off" position when the operator moves his hand from the tool handle, and requires intentional release to reactivate the tool. Other similar switches are described in U.S. Pat. Nos. 3,370,475; 3,646,298; 3,854,020 and 3,847,233.

A review of prior art practices shows that there is clearly a need for a double-acting safety switch that automatically assumes a locked position when released by the operator and that is simple to manufacture and compatible with a variety of tool handles.

SUMMARY OF THE INVENTION

The invention is directed to a hand-operated, double-acting trigger switch mounted in the handle area of a portable electric tool. The switch includes a pivotally-mounted trigger that protrudes from the handle and a safety button also mounted in the handle area. The safety button must first be pushed before the trigger can actuate the tool. The button is part of an integral molded piece that includes a resilient leaf for biasing the trigger to a non-depressed position. When the button is pressed, an abutment that locks the trigger in place is moved out of the way so that the trigger is clear to be depressed. The trigger carries a conductor strip that electrically connects the two electrical contacts on the switch.

DESCRIPTION OF THE PREFERRED EMBODIMENT

Figure 1:
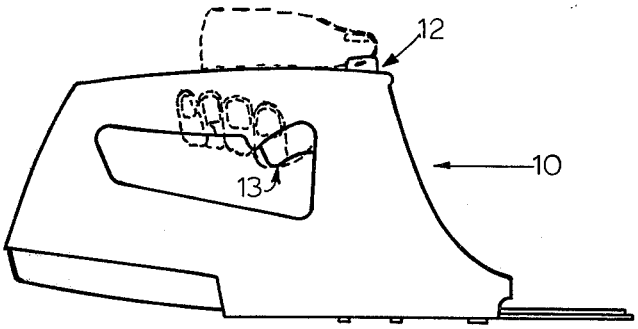
FIG. 1 is a side elevation view illustrating a portable electric grass shear with the invention trigger switch incorporated therein.
Figure 2:
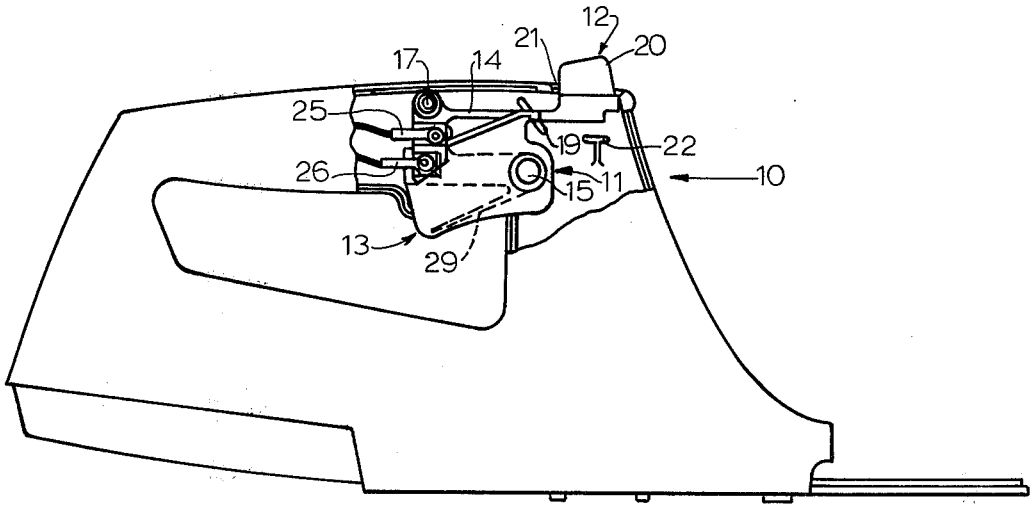
FIG. 2 is an enlarged, fragmentary, side elevation view of the shear of FIG. 1.

Referring to the drawings and particularly to FIGS. 1 and 2, there is illustrated a portable, battery pack powered electric grass shear 10 of a type which utilizes the hand-operated, double-action trigger switch 11 of the present invention. Trigger switch 11 is made up of two separately molded pieces, a button member 12 and a trigger member 13.

Figure 3:
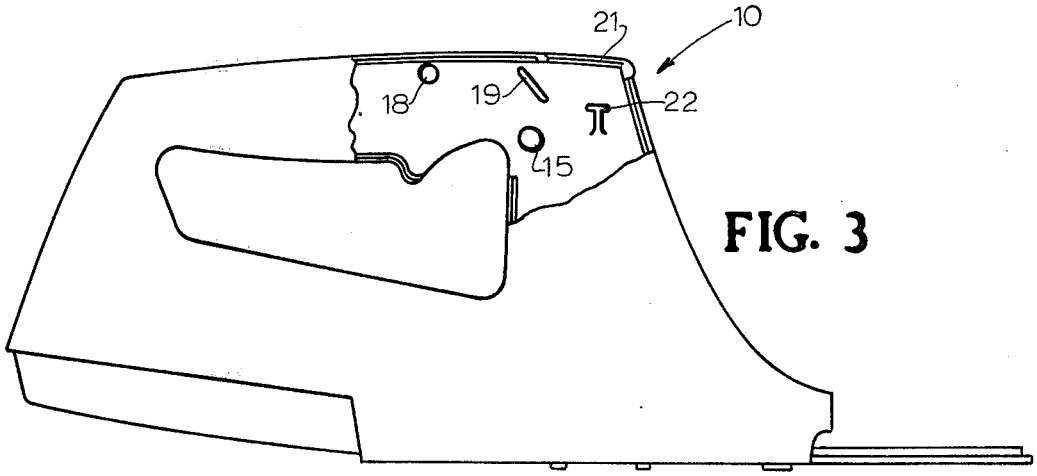
FIG. 3 is a view similar to that of FIG. 2 with the switch mechanism removed to illustrate the switch mounting guides.
Figure 4:
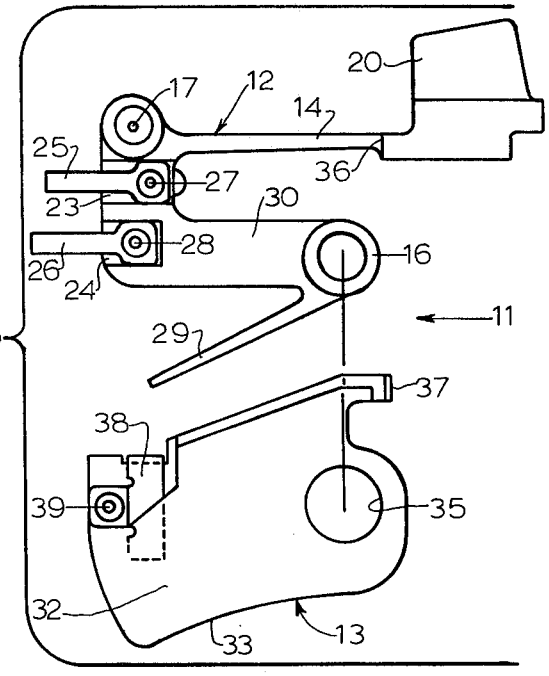
FIG. 4 is an exploded, side elevation view of the button member and the trigger member which together comprises the device of the present invention.
Figure 6:
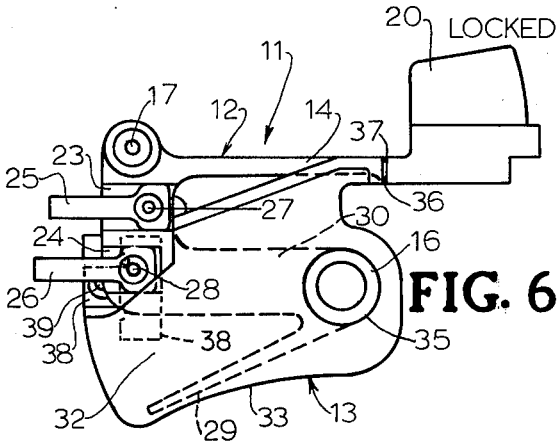
FIG. 6 is a side elevation view of the assembled parts and illustrating the button member and trigger member in a non-actuated or locked position.

Button member 12 is an integral molded plastic piece including an upper resilient leaf spring member 14 which terminates at its remote end in a finger engageable button 20, a body portion 30, a lower resilient spring member 29, a solid pin member 17 and a hollow sleeve 16. Button member 12 is positively located within the tool housing at two points by pin 17 and sleeve 16. Pin 17 resides within a recess 18 in the trigger housing and sleeve 16 is positioned on a post 15 (FIG. 3). The button 20 resides within an opening 21 in the upper handle and, when depressed, bends upper leaf spring 14 downwardly. As explained in detail below, when leaf spring 14 is bent downwardly, a pair of abutments 36 move out of engagement with the trigger and clear the trigger so that it can be depressed. The movement of upper leaf spring 14 is guided by a small guide ledge formation 19 in the tool housing. The distance that button 20 may be pushed inwardly is limited by an abutment ledge 22 also formed in the housing. The lower leaf spring 29 engages the trigger 13 and biases it toward the locked position (FIG. 6). A pair of recesses 23, 24 are molded into button member 12 and serve to receive a pair of connectors 25, 26 which are retained by appropriate rivet contacts 27, 28. Connectors 25, 26 are electrically connected to the lead wires that operatively join the power source to the motor.

Figure 5:
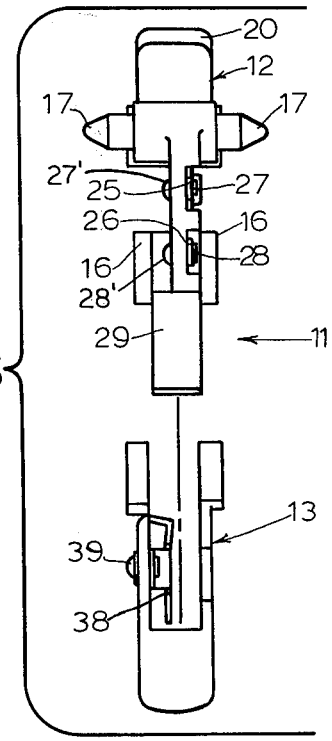
FIG. 5 is an exploded, end elevation view of the device of FIG. 4.

Trigger member 13 is also molded from plastic as an integral substantially hollow piece and includes a body portion 32, a finger engageable surface 33, and a pair of aligned holes 35 which mate with the sleeve 16 of button member 12 to secure member 13 to member 12 for pivoting about sleeve 16. The hollow interior portion of trigger member 13 encloses lower leaf spring 29 and body portion 30 of button member 12. Once button member 12 and trigger member 13 are secured together and mounted within the handle (see FIG. 2), lower leaf spring 29 rests against the inside wall surface of trigger member 13 so as to bias trigger 13 to a non-depressed "off" position. Trigger member 13 also includes a conductor strip 38 mounted on an inside wall thereof by a rivet 39. As explained below, strip 38 is adapted to electrically connect connectors 25, 26 by contacting rivets 27, 28 whose heads 27', 28' make contact with strip 38 when the trigger switch is in the "on" position as illustrated by FIGS. 5 and 8.

Figure 7:
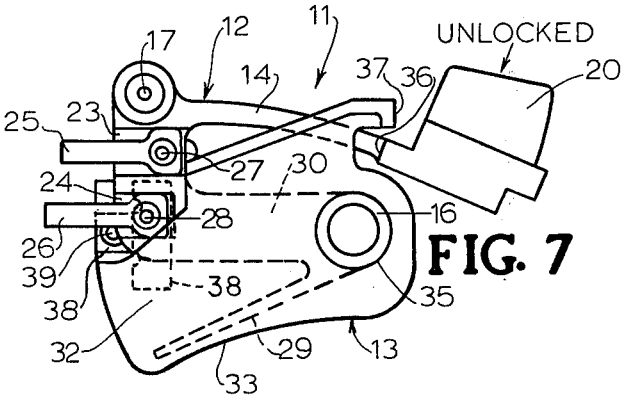
FIG. 7 is a view similar to that of FIG. 6 but with the safety button depressed to the unlocked position.

The sequence of operating the trigger switch 11 will now be described in detail with reference to FIGS. 6, 7 and 8. FIG. 6 depicts the switch 11 in its normal locked position. As noted previously, the aligned holes 35 of trigger member 13 are mounted on sleeve 16 so that the trigger may pivot about the sleeve. The sleeve 16 is, in turn, mounted on the inner walls of the handle housing as is locating pin 17. In the locked position, trigger member 13 is biased downwardly by lower leaf spring 29. The trigger may not be depressed while in the locked position because abutments 36 on upper leaf spring 14 engage the mating trigger wall surfaces 37 to prevent the trigger from pivoting about sleeve 16. Connectors 25, 26 are not engaged with conductor strip 38 since the heads 27', 28' of rivets 27, 28 are out of contact therewith. FIG. 7 illustrates the unlocked position that the switch 11 assumes after button 20 is pushed downwardly, but before the trigger 13 is depressed. In the unlocked position, upper leaf spring 14 is bent downwardly by the force on button 20 until the lower portion of button 20 engages ledge 22 (FIG. 2). At this point, abutments 36 have moved out of contact with trigger walls 37 so that walls 37 may clear the abutments when the trigger is depressed. FIG. 8 depicts the "on" position which the switch assumes after trigger is depressed. Rivets 27, 28 are now brought into engagement with conductor strip 38 and connectors 25, 26 are thereby electrically connected.

Figure 8:
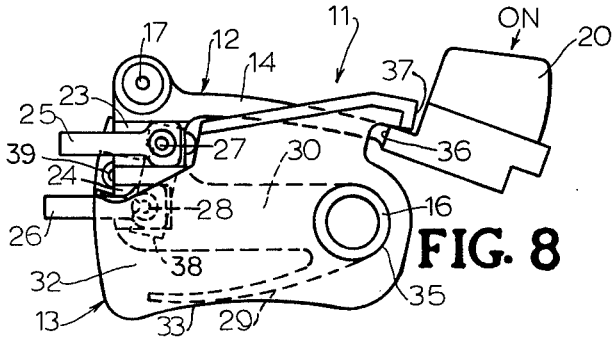
FIG. 8 is a view similar to that of FIGS. 6 and 7 with the safety button depressed and with the trigger also depressed to the operational position.

Once the switch is placed in the "on" position, the operator's thumb may be removed from the button 20 so long as the trigger 13 remains depressed since abutments 36 are held by walls 37 as in FIG. 8. However, it has been found in practice that the operator's thumb will most conveniently remain on the button 20 throughout the operation. Once the button 20 and trigger 13 are released, lower leaf spring 29 biases trigger member 13 back to the non-depressed position and upper leaf spring 14 returns button 20 to its original position so that the switch is once again in the locked position.

Although the switch 11 has been illustrated as embodied in a grass shear, it will be appreciated and from the foregoing that the switch may be utilized with numerous other hand-held tools. The switch of the present invention provides a simple and effective automatic lock mechanism for preventing the accidental actuation of a hand-held electric tool. By first pushing the safety button and then depressing the trigger, the operator may easily place the tool in operation. The switch is compatible with various hand-held tool handles and may be actuated without impairing the ability of the operator to support and manipulate the tool.

What is claimed is:

1. A safety trigger for a hand-held electric power tool including an electric power source and apparatus operated by said source and a hollow handle adapted for being gripped and encircled by the fingers of the operator's hand, comprising:

(a) a manually operable trigger member mounted within the handle including a finger engageable surface extending through a first opening provided in the handle proximate a finger position, said trigger being mounted for pivotal movement about a fixed axis transverse to the longitudinal axis of the handle from an inoperative position to an operative position, said trigger having a hollow portion providing a slide surface for engaging a leaf member to normally bias the trigger outwardly to the inoperative position;

(b) an integrally molded, manually operable safety button member mounted within the handle and including a body portion and a first resilient leaf member extending therefrom and terminating in a thumb engageable button extending through a second opening in said handle proximate a thumb position and being normally biased outwardly through said second opening by said first leaf member and being manually movable within said second opening against the resistance of said first leaf member, and a second leaf member extending from said body portion outwardly into contact with said slide surface of said trigger member for normally biasing said trigger outwardly through said first opening, said body portion being fixedly mounted within the tool housing with said leaf members depending therefrom;

(c) cooperative abutting surface formations on said trigger and button members enabling said safety button member to block rotation of said trigger member except when said button is moved some predetermined amount into said second opening;

(d) cooperative interlocking means on said trigger and button members defining said transverse axis of trigger rotation and serving to join said trigger member to said button member body portion for rotation of said trigger member about said axis; and (e) cooperative electrical contact means carried on said trigger member and said button carrying member for making an electrical connection between the power source and apparatus upon rotation of said trigger member to the operating position.

2. In a portable electric tool of the type having mating clamshell housing halves enclosing an electric apparatus, a source for powering said apparatus and a handle for manipulating said tool, a double-acting safety trigger switch comprising:

(a) an integrally molded, hollow trigger member having a finger engageable surface adapted to protrude through a first opening in one portion of said handle and mounted within said handle for limited rotational movement about an axis transverse to said handle, said trigger member adapted for being manually moved form a non-depressed "off" position to a depressed "on" position;

(b) an integrally molded button member having a body portion fixedly secured between said housing halves and fitting substantially within said trigger member, said body portion mounting said trigger for said limited rotational movement, said body portion having depending therefrom a first leaf spring member for biasing said trigger to said "off" position and a second leaf spring member having a thumb engageable button at the remote end thereof with said button adapted to protrude through a second opening in another portion of said handle, said second leaf spring member having an abutment formed therein adapted in a normal off-locked position to abut a mating contact surface of said trigger member thereby to limit the motion of such trigger member and to maintain said trigger member locked in said "off" position and adapted in an unlocked position wherein said button is depressed so as to deflect said second leaf spring member to clear said trigger contact surface from said abutment thereby freeing said trigger for rotational movement into said "on" position; and (c) cooperative electrical contact means carried on said trigger and button-carrying member for making an electrical connection between the tool source and apparatus in said "on" position and for breaking such connection in said "off" position.

3. In a tool as claimed in claim 2 wherein:

(a) said trigger member includes a mounting aperture;

(b) said button member body portion includes hollow sleeve means extending on both sides thereof interfitting with said trigger member aperture and mounting said trigger member thereon; and (c) wherein said housing halves include means engaging opposite sides of said sleeve means for rotatably mounting the trigger-button member assembly therein.

4. A safety trigger for an electric power tool including an electric power source and apparatus operated by said source and a handle, comprising:

(a) a manually operable trigger member mounted within the handle for pivotal movement about a fixed axis between off and on positions;

(b) a safety button mounting member fixedly positioned within said handle;

(c) a first resilient leaf member carried by said mounting member;

(d) a manually operable safety button carried by said first resilient leaf member and being normally biased toward a first position by said first resilient leaf member and being manually movable along an arcuate path to a second position against the resistance of said first resilient leaf member;

(e) a second resilient leaf member extending from said mounting member and engaging and normally biasing said trigger member to said off position;

(f) cooperating means associated with said button and trigger members operable to prevent movement of said trigger member to said on position except when said button member is moved to said second position;

(g) means mounting said trigger member on said button mounting member for rotation of said trigger member thereon; and (h) cooperating electrical contact means carried by said trigger member and said button mounting member for making an electrical connection between the power source and apparatus upon movement of said trigger member to said on position.

5. A safety switch for selectively connecting an electrical power source and a load comprising:

(a) a fixed member carrying first contact means;

(b) a lock member;

(c) a first flexible arm mounting said lock member on said fixed member for movement on an arcuate path between first and second positions and biasing said lock member toward said first position;

(d) a trigger pivotally carried by said fixed member for movement between on and off position;

(e) a second flexible arm carried by said fixed member and engaging and biasing said trigger to said off position;

(f) cooperating means on said lock member and said trigger for preventing movement of said trigger to said on position when said lock member is in said first position and for retaining said lock member in said second position when said trigger is in said on position; and (g) additional contact means carried by said trigger engageable with said first contact means when said trigger is in said on position to connect said power source and said load.

* * * * *